US010640932B2

(12) United States Patent
Hogan et al.

(10) Patent No.: US 10,640,932 B2
(45) Date of Patent: May 5, 2020

(54) AUTOMATIC WATER SPRAY MILLING FOR COLD PLANER

(71) Applicant: Caterpillar Paving Products Inc., Brooklyn Park, MN (US)

(72) Inventors: Lee M. Hogan, Champlin, MN (US); Eric S. Engelmann, Delano, MN (US); Timothy J. Lindholm, Blaine, MN (US); Paul J. Koenen, Andover, MN (US); Timothy Michael O'Donnell, Long Lake, MN (US); Ryan Adam Enot, Dunlap, IL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/446,273

(22) Filed: Jun. 19, 2019

(65) Prior Publication Data

US 2020/0002902 A1 Jan. 2, 2020

Related U.S. Application Data

(63) Continuation of application No. 16/020,275, filed on Jun. 27, 2018, now Pat. No. 10,370,802.

(51) Int. Cl.

| | |
|---|---|
| ***E01C 19/00*** | (2006.01) |
| ***E01C 23/07*** | (2006.01) |
| ***E01C 23/088*** | (2006.01) |
| ***E01C 19/17*** | (2006.01) |

(52) U.S. Cl.
CPC ..... *E01C 23/07* (2013.01); *E01C 19/176* (2013.01); *E01C 23/088* (2013.01); *E01C 2301/50* (2013.01)

(58) Field of Classification Search
CPC ..... E01C 19/176; E01C 23/07; E01C 23/088; E01C 2301/50
USPC ..... 404/75, 84.05, 111
See application file for complete search history.

(56) References Cited

U.S. PATENT DOCUMENTS

| | | | | |
|---|---|---|---|---|
| 7,942,605 | B2 * | 5/2011 | Hall | B28D 1/186 299/39.2 |
| 8,500,363 | B1 * | 8/2013 | Ries | E01C 19/264 404/104 |
| 9,273,433 | B2 | 3/2016 | Musil | |
| 9,371,618 | B2 | 6/2016 | Killion et al. | |
| 9,689,120 | B2 | 6/2017 | Gaertner et al. | |
| 2012/0043401 | A1 | 2/2012 | Heusinger et al. | |
| 2014/0147206 | A1 | 5/2014 | Menzenbach et al. | |
| 2016/0326701 | A1 | 11/2016 | Schlenker et al. | |

* cited by examiner

*Primary Examiner* — Raymond W Addie
(74) *Attorney, Agent, or Firm* — Miller, Matthias & Hull

(57) ABSTRACT

A spray system for a cold planer machine includes a spray bank disposed inside a housing and arranged to spray fluid directed at a drum and a spray controller. The spray controller is configured to receive an indication of either one of a milling operation and a plunge cut operation is occurring and actuate fluid spray via the spray bank based at least in part on the received indication.

20 Claims, 13 Drawing Sheets

AUTOMATIC WATER SPRAY MILLING FOR COLD PLANER

CROSS REFERENCE TO RELATED APPLICATION

This application is a divisional application of co-pending application Ser. No. 16/020,275 filed Jun. 27, 2018, the disclosure of which is hereby incorporated by reference in its entirety.

TECHNICAL FIELD

The present disclosure relates generally to operation of cold planer or road milling machines. More particularly, it relates to operation of control of fluid spray during machine operations.

BACKGROUND

During road resurfacing, at least a portion of the upper surface of the roadway is removed by specialized equipment to allow a new layer of asphalt to be deposited. A cold planing operation, which may also be referred to as a milling operation, asphalt milling, a plunge cut operation, or profiling, can be carried out at various depths into the road surface. Typically, the asphalt removed from the upper surface is collected for recycling. Cold planing may also be used to control heights and clearances of other road structures, such as curb reveals, manhole and catch basin heights, shoulder and guardrail heights, overhead clearances, and the like in both finished and unfinished road surfaces.

A typical cold planing machine that performs such operations includes a rotating drum encased in a housing, the drum being used for removing or grinding the road surface. The housing prevents debris removed from the road surface from scattering. Further, design of the housing facilitates in transport of the debris for collection. For example, a conveyer system adjacent to the housing collects the road debris at one end of a conveyer belt and ejects the debris to a collection truck at the opposite end of the conveyer belt.

One such planing operation is milling, where the cold planer machine is advancing down the road, and the rotating drum is at a height low enough to interact with the road surface. During such a milling operation, the cold planer machine removes the desired thickness from the road surface as it progresses down the road. Another such planing operation is a plunge cut operation, where the cold planer machine is stationary (e.g., not translating forward or backward), the drum is rotating and being lowered into the road surface. During such a plunge cut operation, the surface of the roadway at one location is removed as the rotating drum is lowered into the road surface.

During the operations removing the road surface, the cold planer machine utilizes fluid spray for lubrication of the rotating drum as it interacts with the road surface and to minimize dust creation. The fluid, such as water, is typically carried onboard the cold planer machine in an onboard retention tank. Excessive use of fluid results in more frequent needs to refill the onboard retention tank and waste of fluid. On the other hand, underuse of fluid spray during operations may result in inadequate lubrication of the drum and excessive dust formation.

U.S. Pat. No. 9,371,618 discloses systems and methods for cold planer spray systems. In particular, the '618 patent discloses operations of pump signals and manifold operations in implementing spray control during cold planer operations. However, there is still a need for automatic water spray milling for cold planer operations.

SUMMARY

In accordance with an aspect of the disclosure, a spray system for a cold planer machine is provided for. The spray system includes a spray bank disposed inside a housing and arranged to spray fluid directed at a drum and a spray controller. The spray controller is configured to receive an indication indicative of either one of a milling operation and a plunge cut operation is occurring and actuate fluid spray via the spray bank based at least in part on the received indication.

In another aspect, a second spray system for a cold planer machine is also provided for. The second spray system includes a spray bank disposed inside a housing and arranged to spray fluid directed at a drum and a spray controller. The spray controller being configured to receive an indication indicative of a milling operation and actuate fluid spray via the spray bank based at least in part on received indication.

In yet another embodiment, a cold planer machine is provided for. The cold planer machine includes a frame, a ground engaging member adapted to interact with a road surface, a retracting vertical actuator system disposed between the frame and the ground engaging member to raise and lower the frame, a housing including a vertical wall movable relative to the frame, a drum enclosed within the housing and arranged to rotate about a drum axis, the drum is connected to the frame and configured to plane the road surface during operation, and a spray system. The spray system includes a spray bank disposed inside the housing and arranged to spray fluid directed at the drum and a spray controller. The spray controller receives an indication indicative of a road surface planing operation and actuates fluid spray via the spray bank based at least in part on receiving the indication indicative of the road surface planing operation.

These and other aspects and features of the present disclosure will be more readily understood upon reading the following detailed description when taken in conjunction with the accompanying drawings. Aspects of different embodiments herein described can be combined with or substituted by one another.

DETAILED DESCRIPTION

The present disclosure relates to fluid controls for a machine. In particular, to a fluid spray system for a cold planer machine. Although the present embodiments are described in the context of a fluid spray system for a cold planer machine, it should be appreciated that the spray systems and methods described are applicable to other machines and applications in which use of a secondary or working fluid, such as water, is conserved by accurate and automated control that depends on the operations performed by the respective machine.

Figure 1:
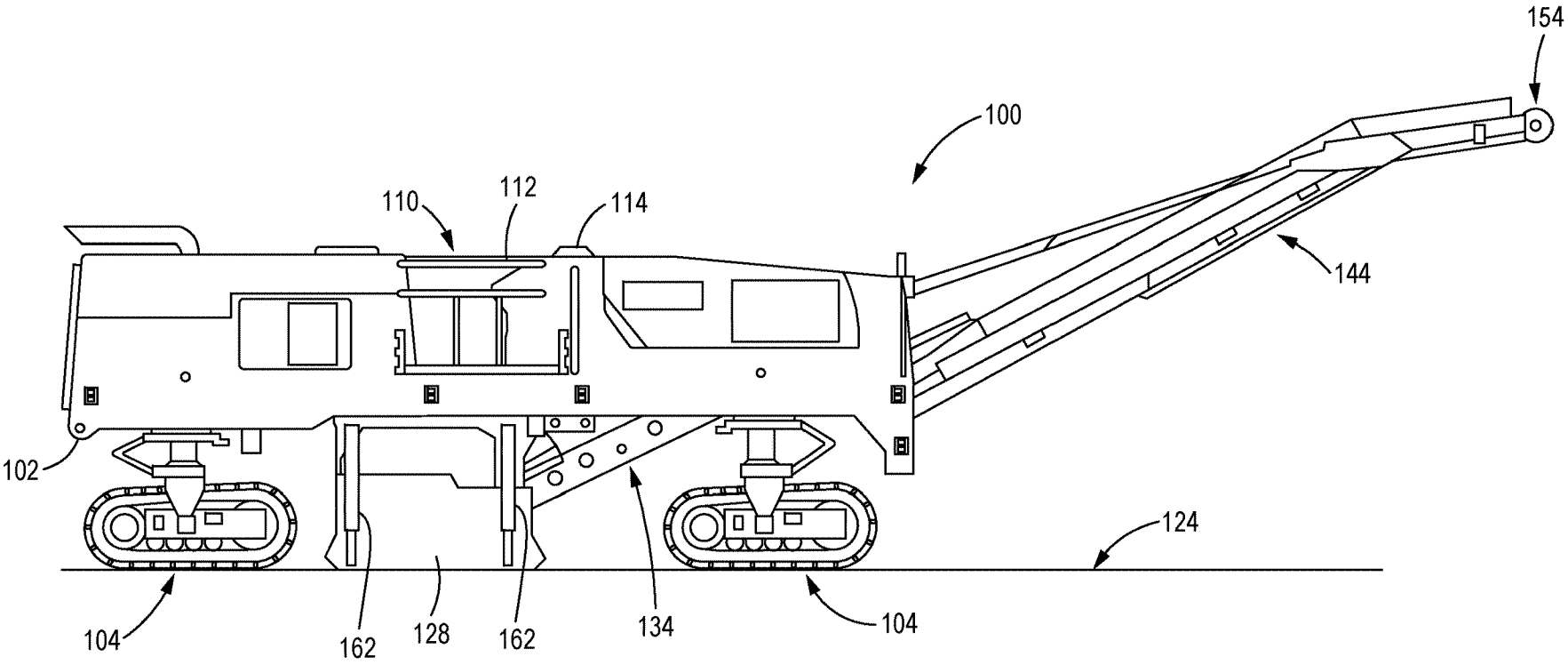
FIG. 1 is a side overview of a machine in accordance with an embodiment of the present the disclosure.
Figure 2:
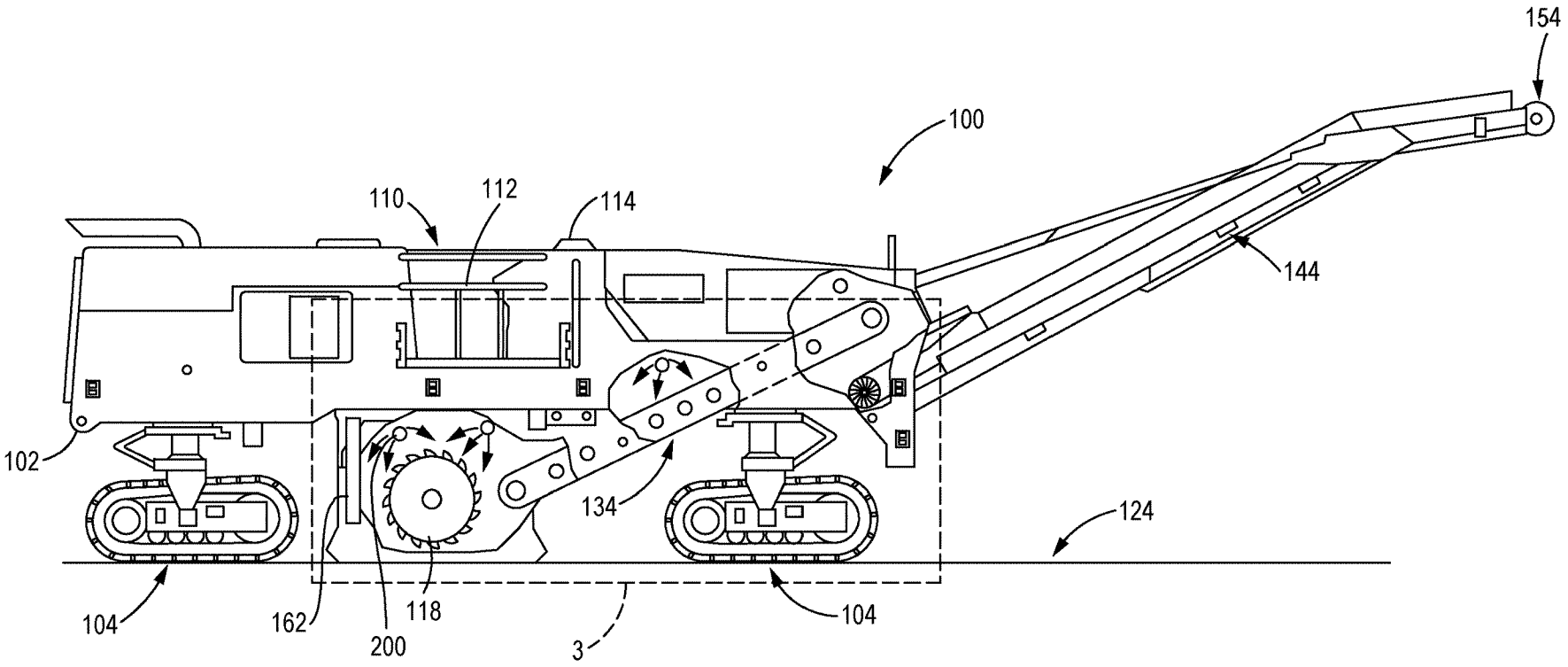
FIG. 2 is a partially fragmented view of the machine depicted in FIG. 1, in accordance with an embodiment of the present disclosure.
Figure 3:
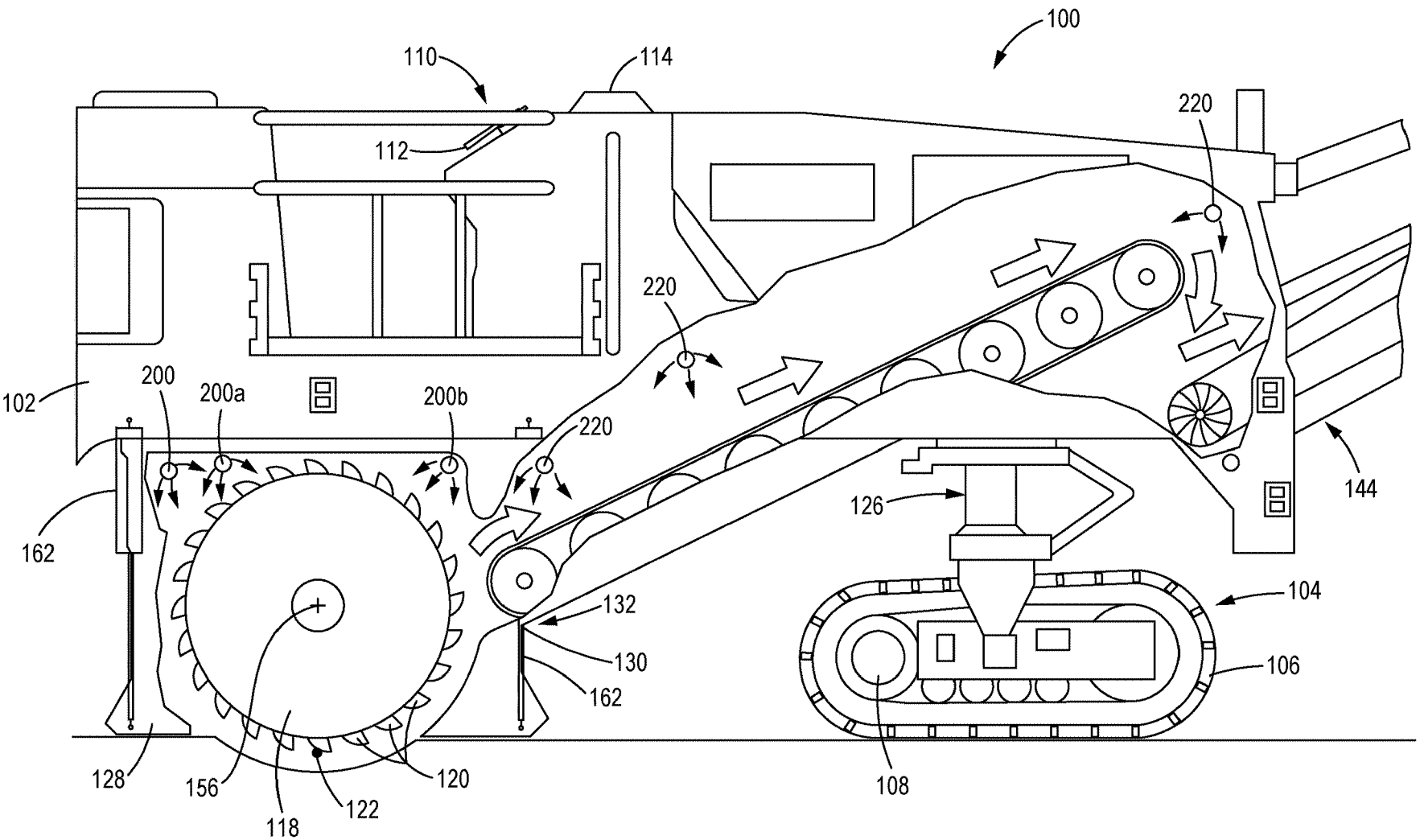
FIG. 3 is an enlarged detail view of area 3 of FIG. 2, in accordance with an embodiment of the present disclosure.

Referring now to the drawings, in which like reference numerals represent like parts throughout the serial views, FIG. 1 depicts a side overview of an exemplary cold planer machine. In particular, FIG. 1 depicts the cold planer machine 100 in accordance with an embodiment. FIG. 2 shows a fragmented view of the cold planer machine 100 and FIG. 3 shows an enlargement of area 3 of FIG. 2. A typical cold planer machine, such as the cold planer machine 100, includes a frame 102 that is supported by ground engaging members 104. The cold planer machine 100 may have four different ground engaging members 104, and FIG. 1 depicts the two right-side ground engaging members 104, one on the front-side of the machine on the right of FIG. 1 and one on the rear-side of the machine on the left of FIG. 1.

The ground engaging member 104 is adapted to interact with the road surface 124. As such, it may include a track 106 that is driven by a drive motor 108. The drive motor 108 may be realized by a hydraulic motor or other similar type of motor as known by those with skill in the art. Further, the drive motor 108 may be configured to operate in two directions, causing the track 106 to operate in either a clockwise or counter-clockwise direction. Different ground engaging members 104 may operate independently of each other and at different speeds and directions to cause the cold planer machine 100 to maneuver forwards, backwards, and to turn.

The cold planer machine 100 may also include a retracting vertical actuator system 126 disposed between the frame 102 and the ground engaging members 104. Each ground engaging member 104 may have a separate retracting vertical actuator 126 that raises and lowers the frame 102 according to the operational needs of the cold planer machine 100. Similar to the ground engaging members 104, each of the retracting vertical actuators 126 may operate independent from each other. For example, the two retracting vertical actuators 126 on the left side of the cold planer machine 100 may extend further than the two retracting vertical actuators 126 on the right side of the cold planer machine 100. This may cause a left-side of the cold planer machine 100 to be higher above the road surface 124 than the right side of the cold planer machine 100. Such operations may be used to align the drum axis 156, and thus the bottom of the drum 122, with the road surface 124 for even planing or sloped planing of the road surface 124.

Operation of the cold planer machine 100 may be carried out remotely or locally by an operator portion 110. From the operator portion 110, an operator may manipulate various machine control devices such as one or more steering devices 112, a control panel 114 that includes various control switches, and the like. A remote operator may be in communication with the cold planer machine 100 and perform all of the control aspects that a local operator would perform at the operator portion 110.

The frame 102 further supports an engine and an onboard retention tank (not shown). The engine is connected to various mechanical, hydraulic, and electrical systems to operate various portions of the cold planer machine 100. The onboard retention tank may store working fluid, such as water, for use during operation of the cold planer machine 100.

For performing planing operations on the road surface 124, the cold planer machine 100 includes a drum 118 that is rotatably supported on the frame 102 and configured for powered rotation relative thereto about the drum axis 156 during operation. The drum 118 has a generally cylindrical shape, although other shapes are considered, and includes a plurality of cutting elements or teeth 120 that are disposed along an outer portion of the drum 118. The drum 118 includes a bottom 122 that is the closest portion of the drum to the road surface 124. The bottom of the drum 122 may also include the bottommost portion of the teeth 120.

The drum 118 is enclosed within a shield or housing 128. The housing 128 may include four substantially vertical walls: a left-side wall, a right-side wall, a front wall, and a back wall. As discussed throughout, the housing walls may be referred to as a vertical wall 160. The walls generally extend from the frame 102 to the road surface 124. A front wall 130 of the housing 128 includes an opening 132, through which an inlet portion of the conveyer system 134 extends. During drum rotation, road debris is flung by the drum 118 and transferred from the inlet portion of the conveyer system 134 upwards and to the right—as depicted by arrows in FIG. 3—to the output side 154 of the conveyer system 134. In some embodiments, a secondary conveyer system 144, similar to the conveyer system 134, is used to transport the road debris from the conveyer system 134 to the output side 154. At this point, the road debris may be transferred to a second machine, such as a dump truck (not shown) operating in tandem with the cold planer machine 100.

Also depicted on the housing is a position detector 162. In the embodiment depicted in FIGS. 1-3, the position detector 162 may be any number of position-sensing hydraulic cylinders (e.g., a position-sensing hydraulic cylinder system), although other position detectors are envisioned and discussed throughout the disclosure. The position detector 162 determines a relative vertical distance 164 between the vertical wall 160 and the frame 102, and is discussed in more detail throughout the present disclosure.

To control dust, airborne debris, and to provide lubrication and cooling to the drum 118, a spray bank 200 is disposed within the housing 128. The spray bank 200 may be in fluid communication with a fluid source, such as the onboard retention tank, and may include at least one nozzle arranged to spray a fluid directed at the drum 118. The housing may also include additional spray banks (200*a*, 200*b*) spaced throughout the housing and also in fluid communication with the fluid source. The additional spray banks (200*a*, 200*b*) may be actuated as needed based on operations of the cold planer machine 100. Examples operations where additional fluid spray via the additional spray banks (200*a*, 200*b*) is desirable may include operations that produce a high amount of airborne debris, for example based on the type of road surface being worked on. In some embodiments, the controller 210 is configured to secure fluid spray after a determination that the cold planer machine is no longer performing a milling operation. In some such embodiments, fluid spray via the additional spray banks (200*a*, 200*b*) may be secured at the time that the cold planer machine makes the determination that the cold planer machine is no longer performing the planing operation and maintain fluid spray via the spray bank 200 until a time delay has elapsed.

Another example of an operation that additional fluid spray is desirable includes an operation that produces a high amount of heat. Such operations may be detected by a speed of advance of the cold planer machine during a milling operation (e.g., as determined by the operating speed of the drive motor 108) or the speed that the drum 118 is being inserted into the road surface 124 during a plunge cut operation (e.g., as determined by the rate of change of the relative vertical distance 164 between the frame 102 and the vertical wall 160). Such operations may be automatically detected and additional fluid spray, via the additional spray banks (200*a*, 200*b*) may be automatically actuated. Additionally, an operator may adjust operational settings for fluid spray flow at the control panel 114.

Further, the conveyer system 134 may also be equipped with a conveyer system spray bank 220. The conveyer system spray bank 220 generates fluid spray towards the material (e.g., road debris) being transported from the housing 128 out of the cold planer machine 100. Although not depicted, the secondary conveyer system 144 may also include spray banks similar to the conveyer system spray bank 220.

Figure 4:
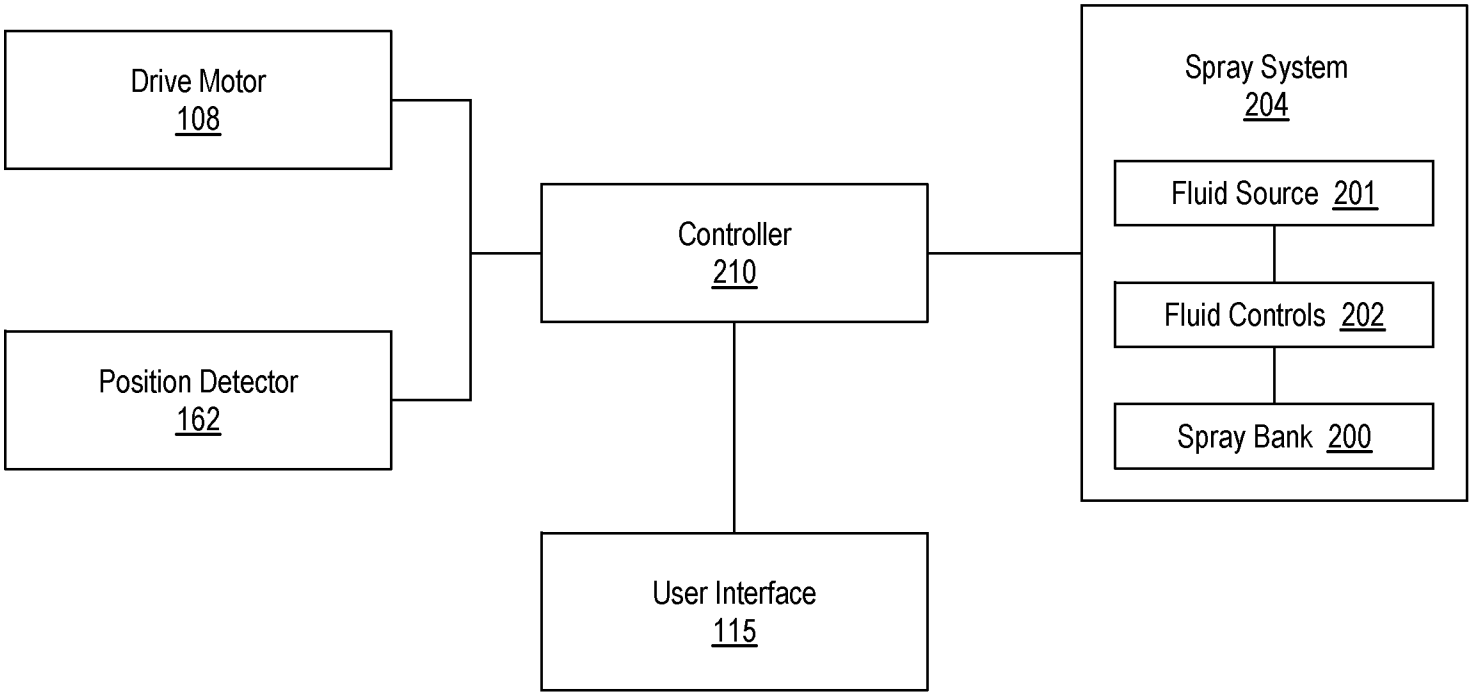
FIG. 4 is a block diagram of machine components, in accordance with an embodiment of the present disclosure.

FIG. 4 is a block diagram of cold planer machine components, in accordance with an embodiment of the present disclosure. In particular, FIG. 4 depicts functional relationships between a controller 210, the drive motor 108, the position detector 162, a user interface 115, and a spray system 204. The spray system 204 includes a fluid source 201, fluid controls 202, and the spray bank 200. The spray system 204 may also include the additional spray banks 200*a*, 200*b* and the conveyer system spray bank 220.

The drive motor 108 provides an input to the controller 210 related to the status of drive motor 108 operation. For example, if the drive motor 108 is activated and engaged, the drive motor 108 may provide activation status signals to the controller 210. Further, if the drive motor 108 is in neutral (e.g., not engaged) it may similarly provide status signals to the controller 210 indicating that the respective drive motor 108 is not advancing the cold planer machine 100. Each of the drive motors 108 in the respective ground engaging members 104 may provide individual status signals to the controller 210. The status signals may further include direction of operation, speed of activation, and the like. The controller 210 is configured to determine if the cold planer machine 100 is advancing based at least in part on the status signals received from the drive motor(s) 108.

The position detector 162 provides measurements to the controller indicative of a relative vertical distance between a vertical wall 160 on the housing 128 and the frame 102. In various embodiments, the position detector 162 provides raw distance measurements and the controller is configured to determine the relative distance. In other embodiments, the position detector 162 may be configured to provide the relative distance information directly to the controller 210. Further, the controller 210 may also determine or receive a rate of change of the relative distance measurements from the measurements received from the position detector 162.

In some embodiments, the controller 210 may be realized by one or many standard computer operating devices having a processor. The processor may include a local memory and be in communication with a main memory including a read-only memory and a random access memory via a communication bus. The random access memory may be implemented by Synchronous Dynamic Random Access Memory (SDRAM), Dynamic Random Access Memory (DRAM), RAMBUS Dynamic Random Access Memory (RDRAM) and/or any other type of random access memory device. The read-only memory may be implemented by a hard drive, flash memory and/or any other desired type of memory device.

The computing device may also include or be configured to communicate with an interface circuit, such as the user interface 115 or a remote user interface. The interface circuit may be implemented by any type of interface standard, such as a wireless interface, an Ethernet interface, a universal serial bus (USB), and/or a PCI express interface. One or more input devices are connected to the interface circuit via a communication bus. The input device(s) permit an operator to enter data and commands into the processor. The input device(s) may be implemented by, for example, a keyboard, a keypad, a touch screen, a mouse, a track-pad, a trackball, a push-button, a toggle switch, and/or a voice recognition system. The input device(s) may include any wired or wireless device for providing input.

A visual display may also connected to the interface circuit. The visual display may be implemented by, for example, one or more display devices for associated data (e.g., a liquid crystal display, a cathode ray tube (CRT) display, and indicator lights) and may be combined or substituted by audible warnings and indications.

The computing device may be used to execute machine readable instructions. For example, the controller 210 may execute machine readable instructions to perform any of the methods or operations disclosed herein. For example, actuating spray via the spray bank based at least in part on determining that the relative vertical distance is above a first threshold height. In such examples, the machine readable instructions comprise a program for execution by a processor. The program may be embodied in software stored on a tangible computer readable medium such as a CD-ROM, a floppy disk, a hard drive, a digital versatile disk (DVD), a Blu-ray™ disk, or a memory associated with the processor, but the entire program and/or parts thereof could alternatively be executed by a device other than the processor and/or embodied in firmware or dedicated hardware. Additionally, the controller 210 may be local to the cold planer machine 100 or be remotely located, but in communication with, the cold planer machine 100.

The spray system 204 includes a fluid source 201, fluid controls 202, and a spray bank 200. The spray system 204 is configured to transmit fluid from the fluid source 201 (e.g., the onboard retention tank, an external source) via the fluid controls 202 to the spray bank 200 for use in spraying the fluid during operation of the cold planer machine 100. As mentioned above, additional spray banks may further be connected to the fluid source 201, and the fluid controls 202 may be used to actuate spray flow through both the spray banks, the conveyer system spray banks, and the additional spray banks in response to receiving control signals from the controller 210. In some embodiments the fluid source 201 comprises a single fluid, such as water. In other embodiments, multiple different fluids may be used. For example, water may be stored in one onboard retention tank and a water additive may be stored in a separate onboard retention tank. Alternatively, fluid may be supplied from an external source and mixed with an additive stored in an onboard retention tank on the cold planer machine 100 before being directed to the spray banks for spray flow. The fluid controls 202 may be configured to mix the fluids from the different tanks in the desired proportions for the operations.

The fluid controls 202 control aspects of actuation of fluid flow from the fluid source 201 to the spray bank 200. In some embodiments, the fluid is also directed to additional spray banks (200*a*, 200*b*) or the conveyer system spray bank 220, or other spray banks or fluid connections used throughout the cold planer machine 100 by the fluid controls 202. Various components of the fluid controls 202 may also include components used in the pressurization and flow control of fluid throughout the cold planer machine 100. In one exemplary embodiment, a pump is activated to transport fluid from the fluid source 201 to the spray bank 200. Control of fluid flow may be realized by different valves (e.g., throttle valves, flow control valves, check valves, ball valves, and the like.) The various valves may be solenoid operated, hydraulically operated, or the like, and operate in response to control signals received from the controller 210.

In another exemplary embodiment, the fluid controls 202 includes an air compressor that pressurizes an overhead space in the onboard retention tank, and flow control valves limit/restrict or permit flow of the pressurized fluid to the various spray banks. In such an embodiment, the controller 210 may control operation of the air compressor to maintain proper pressure in the onboard retention tank and also control operation of various valves controlling the flow of the fluid. In yet another exemplary embodiment, pressurized fluid from an external source is provided to the cold planer machine 100, and different control valves associated with each of the spray banks limit/restrict or permit flow from the pressurized external fluid source to the spray bank. Other methods and systems for actuating spray flow by the controller 210 are also envisioned by the inventors.

Figure 5:
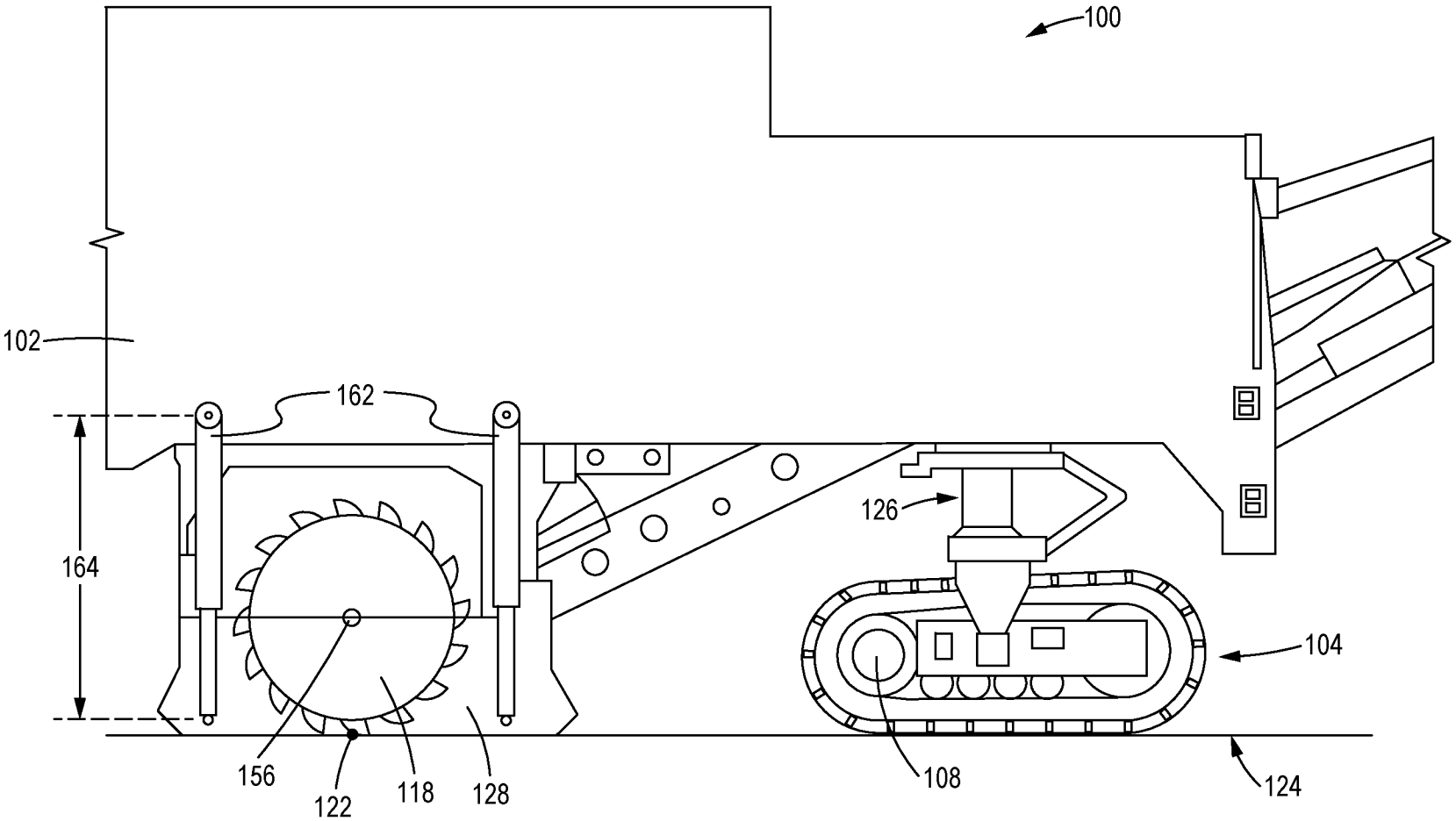
FIG. 5 is a schematic side view of a machine, in accordance with an embodiment of the present disclosure.

FIG. 5 is a schematic side view of a cold planer machine, in accordance with an embodiment of the present disclosure. In particular, FIG. 5 depicts a partial side view of the cold planer machine 100. In FIG. 5, a ground engaging member 104 is adapted to interact with the road surface 124. The frame 102 is raised and lowered above the road surface 124 by the retracting vertical actuator system 126. Although FIG. 5 only depicts one ground engaging member 104 and its respective retracting vertical actuator 126, it is envisioned that a cold planer machine may have any number of ground engaging members 104 and retracting vertical actuators. Thus, the height, list, and tilt of the frame 102 may be adjusted by operating each of the different retracting vertical actuators 126. For example, a cold planer machine's two right-side vertical actuators 126 and two left-side vertical actuators 126 may adjust the list of the frame 102 by extending the two right-side vertical actuators 126 greater than the two left-side vertical actuators 126, leaving the right-side of the frame 102 higher than the left side of the frame 102. This may be accomplished to adjust for uneven road surfaces (e.g., where the right side of the road surface is lower than the left side of the road surface) or it may be accomplished in order to tilt the drum axis 156 so that the road surface 124 is sloped after the planing operation.

In some embodiments, the drum 118 is fixed to a set height in relation to the frame 102. Thus, when the frame 102 is raised, lowered, or tilted, the drum 118 is raised, lowered, or tilted an equal amount as the frame 102. The housing 128 includes a vertical wall 160 that is movable relative to the frame 102. The vertical wall 160, in some operational modes, abuts against the road surface 124. Thus, when the frame 102 is raised, the vertical wall 160 may stay resting on (e.g., abut against) the road surface 124. The position detector 162 is configured to determine the relative vertical distance 164, or a relative height measurement, between the vertical wall 160 and the frame 102. As depicted in FIG. 5, the relative vertical distance 164 is in at a "scratch height," with the bottom of the drum 122 at the same height as the bottom edge 171 of the vertical wall 160 resting on the road surface 124. Thus, if the frame 102 (and drum 118) is lowered any further, the drum 118 will be at a height such that if rotating, it will cut into the road surface 124 underneath the drum 118.

As seen in FIG. 5, if the retracting vertical actuator 126 retracts further, the frame 102 is lowered, but the vertical wall 160 maintains at the same height as it is already resting on the road surface 124. Thus, the frame is lowered beneath the "scratch height" and the relative vertical distance 164 is decreased. Conversely, if the retracting vertical actuator 126 extends further, the frame 102 is raised, and the vertical wall 160 maintains resting on the road surface 124. Thus, the relative vertical distance 164 is increased. While the relative vertical distance 164 in FIG. 5 is depicted as the distance between two attachment points for the position detector 162 (one on the frame 102 and one on the vertical wall 160) it should be understood that the position detector 162 may be configured to determine a relative vertical distance between any point on the frame and any point on the vertical wall to account for movement relative between the two objects. Example variations of the position detector 162 measuring the relative vertical distance 164 are discussed throughout the present disclosure.

Figure 6:
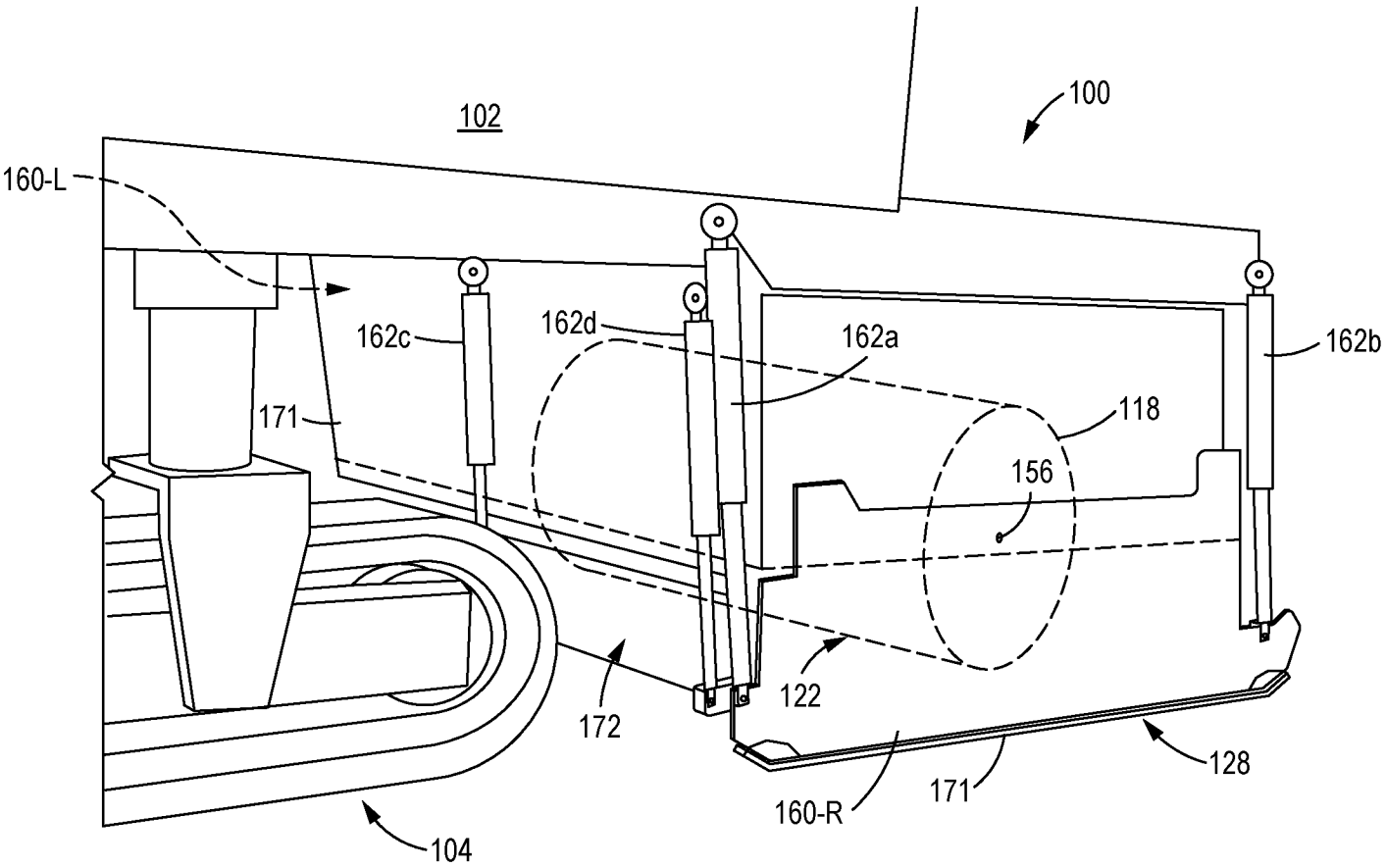
FIG. 6 is a perspective view of a machine, in accordance with an embodiment of the present disclosure.

FIG. 6 is a perspective view of a machine, in accordance with an embodiment of the present disclosure. In particular, FIG. 6 depicts the housing 128 of the cold planer machine 100. In the perspective view, a right-side and a rear-side of the housing 128 is visible. The drum 118 appears as cylindrical-shaped within the housing 128, and the bottom of the drum 122 extends along a straight line. However, in some embodiments, the drum 118 is not cylinder shaped, and may vary its cross-sectional diameter along the drum axis 156. For example, the drum 118 may bow out (e.g., have a larger diameter) in either the middle or at the ends, or it may be frusto-conical with the cross-sectional diameter at one end being larger than the other end.

The right side of the housing 128 includes the vertical wall 160-R, with the relative vertical distance between the vertical wall 160-R and the frame 102 being determined at least in part by the position-sensing hydraulic cylinders 162*a* and 162*b*. The position-sensing hydraulic cylinder 162*a* is attached to the frame 102 at a top portion and is attached to the rear of the vertical wall 160-R at a bottom portion. The position-sensing hydraulic cylinder 162*b* is attached to the frame 102 at a top portion and is attached to the front of the vertical wall 160-R at a bottom portion.

The rear of the housing 128 includes a rear mold board 172 that, similar to the vertical wall 160-R, includes the left-side position-sensing hydraulic cylinder 162*c* and the right-side position-sensing hydraulic cylinder 162*d*. However, it is envisioned that the rear mold board 172 may include just one position-sensing hydraulic cylinder. The rear mold board 172 is movable in relation to the frame 102, and the position-sensing hydraulic cylinders 162*c*, 162*d* may be used to determine a relative vertical distance between the rear mold board 172 and the frame 102. Although not depicted, the housing 128 may further include a left-side vertical wall (160-L) with a similar position detector 162.

Figure 7:
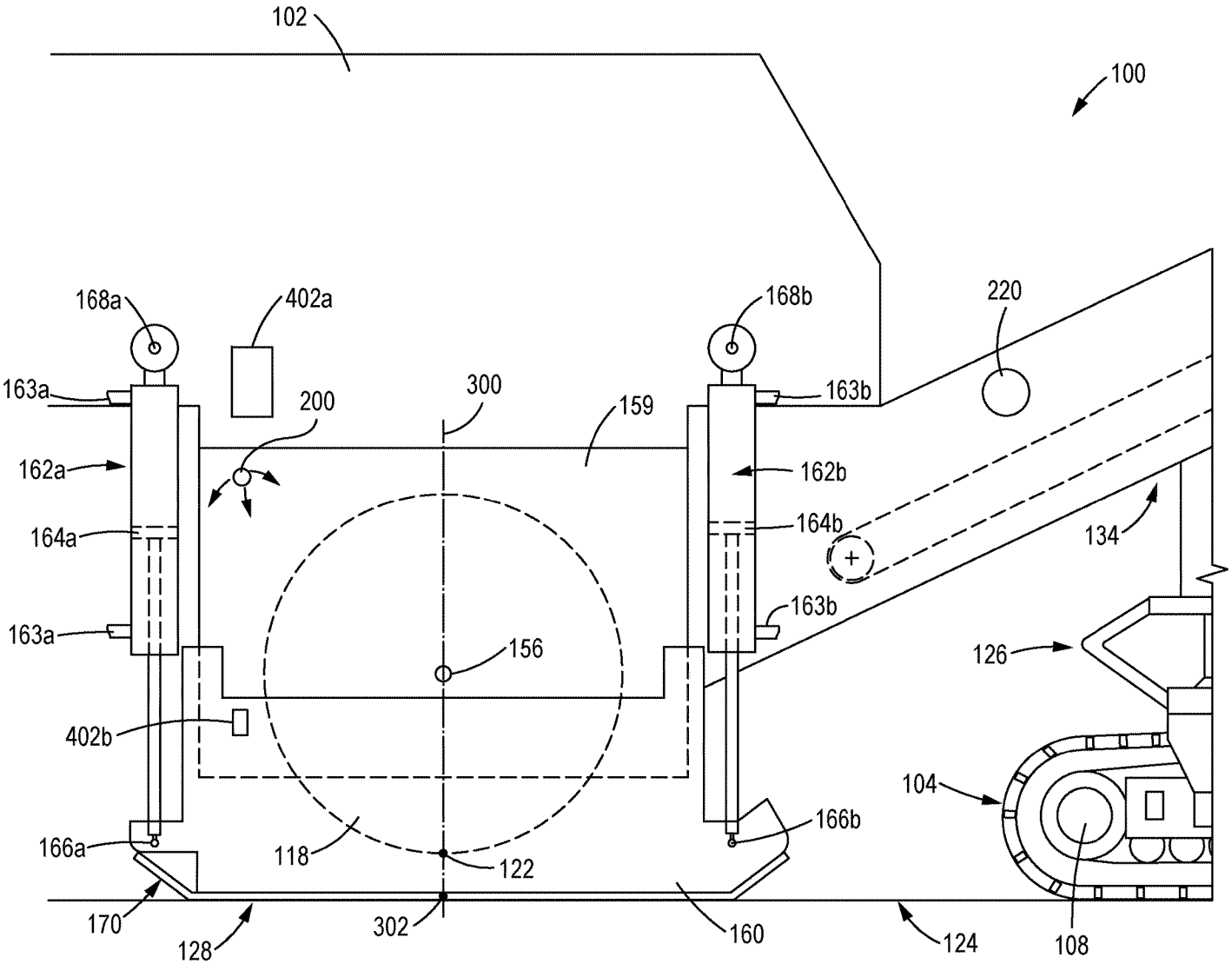
FIG. 7 is a detailed side view of a machine, in accordance with an embodiment of the present disclosure.

FIG. 7 is a detailed side view of a machine, in accordance with an embodiment of the present disclosure. In particular, FIG. 7 depicts a detailed side view of the housing 128, of which a simplified view is used throughout FIGS. 8-11 to depict the cold planer machine 100 performing different operations. Although the right-side of the housing 128 is depicted, the aspects disclosed herein may be applicable to the various other sides (e.g., the rear mold-board or left-side vertical wall/side plate) of the housing 128. Here, the housing 128 includes an upper wall 159 that is fixed in relation to the frame 102. The upper wall 159 assists in providing an enclosure to prevent road debris and dust from escaping the housing 128. Mounting equipment (not shown) for the drum 118 may be affixed to the upper wall 159 to permit the drum 118 to rotate about the drum axis 156. The vertical wall 160 may translate vertically adjacent to the upper wall 159, with portions of the vertical wall 160 overlapping the upper wall 159. A seal or a gasket may be placed at the junction of the vertical wall 160 and the upper wall 159. Further, the vertical wall 160 and the upper wall 159 may include guides to assist the vertical wall 160 to translate vertically adjacent to the upper wall 159. The vertical wall 160 may be disposed on an outside location of the housing 128 relative to the upper wall 159.

In one embodiment, the position detector 162 is realized by the front position-sensing hydraulic cylinder 162*b* and the rear position-sensing hydraulic cylinder 162*a*. A top portion of the position-sensing hydraulic cylinder 162*a* is attached to the frame 102 at attachment point 168*a*. A bottom portion of the position-sensing hydraulic cylinder 162*a* is attached to the vertical wall 160 at the attachment point 166*a*. The front position-sensing hydraulic cylinder 162*b* is similarly attached at the attachment points 168*b* and 166*b*. The attachment points 166*a*, 166*b*, 168*a*, 168*b* may pivot to allow for variations of tilt of the frame 102 relative to the vertical wall 160.

The position-sensing hydraulic cylinders 162*a* and 162*b* may include respective hydraulic connections 163*a*, 163*b* and pistons 164*a*, 164*b*. When operating in a manual mode of operation, pressurized hydraulic fluid is provided to either side of the pistons 164*a*, 164*b* via the hydraulic connections 163*a*, 163*b* to cause the position-sensing hydraulic cylinder 162*a*, 162*b* to extend or retract and causing the vertical wall 160 to translate vertically either up or down. When operating in a float mode of operation, the pistons 164*a*, 164*b* are permitted to translate up and down based on the relative vertical distance between the frame 102 and the vertical wall 160. Typically, gravity keeps the vertical wall 160 abutting against the road surface 124 when the position-sensing hydraulic cylinders 162*a*, 162*b* are operating in a float mode. Extension of the retracting vertical actuator system 126 would raise the frame 102 and cause the position-sensing hydraulic cylinders 162*a*, 162*b* to further extend.

The various position-sensing hydraulic cylinders discussed herein are configured to provide, to the controller 210, either analog or digital electronic position feedback information from the cylinder that indicates the amount of rod extension throughout the range of stroke. These may be realized by cylinders with an in-cylinder linear displacement transducer (Internal LDT), an external LDT, or other similar technologies.

In another embodiment, the position detector 162 is realized by at least one light detection and ranging (LIDAR) sensor. For example, the LIDAR sensor 402*a* is affixed to the frame 102 and is configured to measure a height of the frame 102 above the road surface 124. The LIDAR sensor 402*b* is affixed to the vertical wall 160 and is configured to measure a height of the vertical wall 160 above the road surface 124. The distance measurements from the LIDAR sensors 402*a*, 402*b* may be provided to the controller 210 for use in determining the relative vertical distance 164.

In yet other embodiments, additional sensors (e.g., a gyroscope, an accelerometer) may be affixed to either the frame 102 or the vertical wall 160 in order to determine additional position information of components of the frame 102 or the vertical wall 160. For example, an accelerometer may be used to determine how fast the frame 102 or vertical wall 160 is being raised or lowered, and thus the rate of relative height change of the vertical wall 160 may be determined. A gyroscope may measure an angle of the vertical wall 160. Combined with a relative distance measurement from a position detector 162, such as the position-sensing hydraulic cylinder 162*a*, the relative height at any point along the bottom edge 171 may be determined. In some such embodiments with a LIDAR sensor 402, the vertical walls 160 may not include position-sensing hydraulic cylinders, but hydraulic cylinders or other methods to raise, lower, and reposition the vertical walls. In other embodiments, the position detector 162 may be realized by at least one of a string pot, a rotary device, a sonic sensor, or the like.

The vertical wall 160 includes a bottom edge 171 that may be realized by a skid 170. As the cold planer machine 100 operates to plane the road surface 124 beneath the drum 118, the skid 170 abuts against the road surface 124. The bottom of the drum 122 (which may be interpreted as the bottom-most portion of machining tools, cutting elements, or teeth 120) first interacts with the road surface 124 near the position 302. Thus, it may be desirable to know the relative height of the bottom edge 171 at the position 302 (e.g., in proximity to the bottom of the drum 122) for use in determining when to actuate fluid spray. To further define the location of the position 302, in some embodiments, the vertical plane 300 intersects the drum axis 156 and the bottom of the drum 122. The vertical plane 300 extends further downward to intersect the bottom edge 171 at the position 302. The following FIGS. 8-12 provided a more simplified view of the cold planer machine 100 than FIG. 7, with components removed for clarity. Throughout the several views, the block diagram of FIG. 4 may be used concurrently to disclose operation of the cold planer machine 100. Although the following figures depict the position detector 162 being position-sensing hydraulic cylinders, certainly other systems may be used to determine the relative vertical distance 164.

Figure 8:
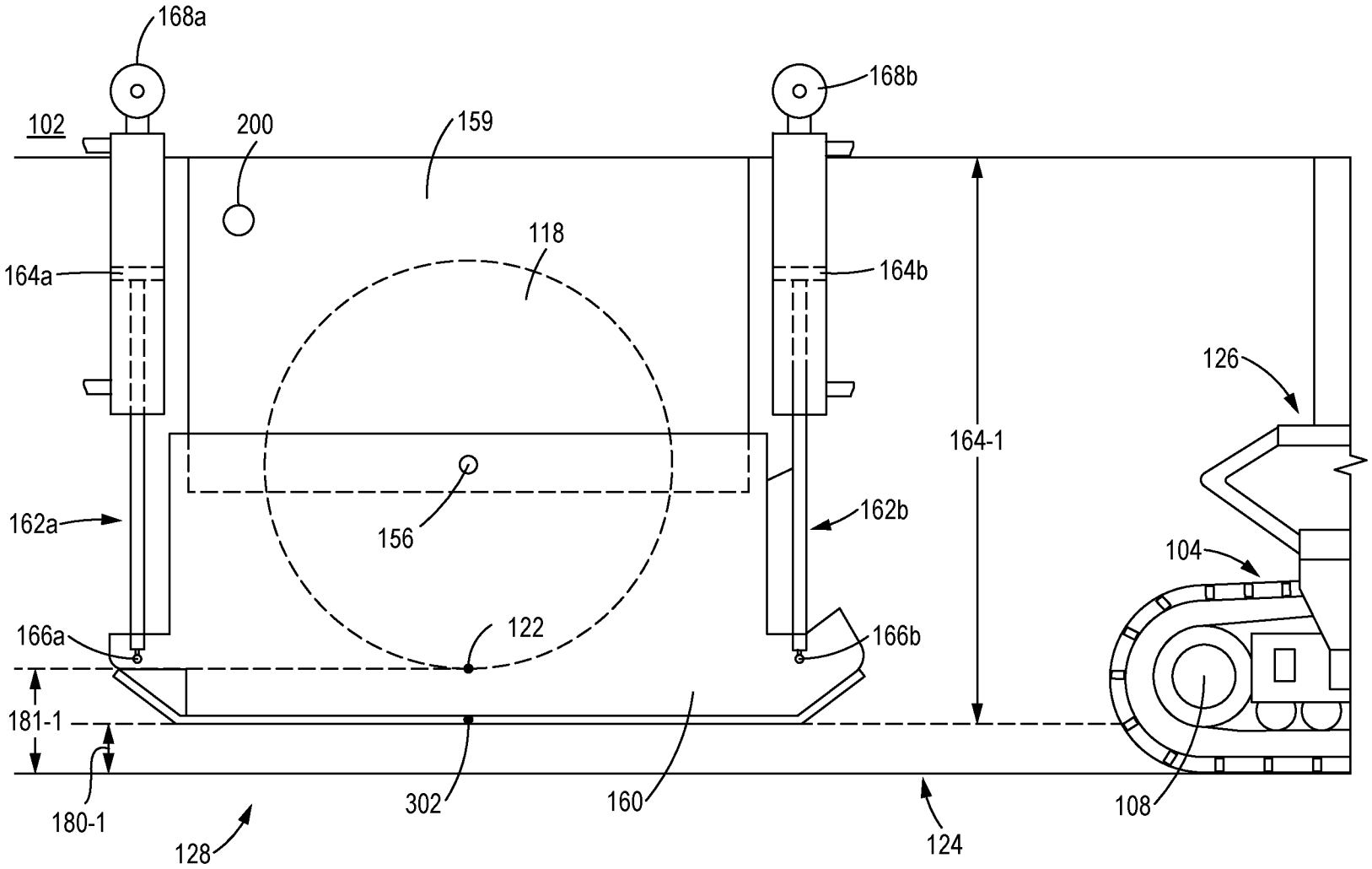
FIG. 8 is a side view of a machine in a first mode of operation, in accordance with an embodiment of the present disclosure.

FIG. 8 is a side view of a machine in a first mode of operation, in accordance with an embodiment of the present disclosure. In particular, FIG. 8 depicts the cold planer machine 100 operating with the position-sensing hydraulic cylinders 162*a*, 162*b* operating in a manual mode. Control of the position-sensing hydraulic cylinders 162*a*, 162*b* may be via control signals from the controller 210. Here, hydraulic pressure is provided to the underside of the pistons 164*a*, 164*b* to raise (e.g., maintain raised) the vertical wall 160. The relative vertical distance 164-1, which may also be referred to as the relative height position between the vertical wall/side plate and the frame 102, is measured between the bottom portion of the frame 102 and the position 302 along the bottom edge 171. In this depiction, the height 181-1 measures the distance between the road surface 124 and the bottom of the drum 122. The bottom of the drum 122 is depicted above the road surface 124. The height 180-1 measures the distance between the position 302 and the road surface 124. The position 302 is also above the road surface 124 in FIG. 8. The relative vertical distance 164-1 and the heights 180-1, 181-1 will be varied throughout the following figures in the different modes of operation, and will be indicated by increasing references numbers. (e.g., 164-2, 180-2, and 180-2 in FIG. 9.)

Figure 9:
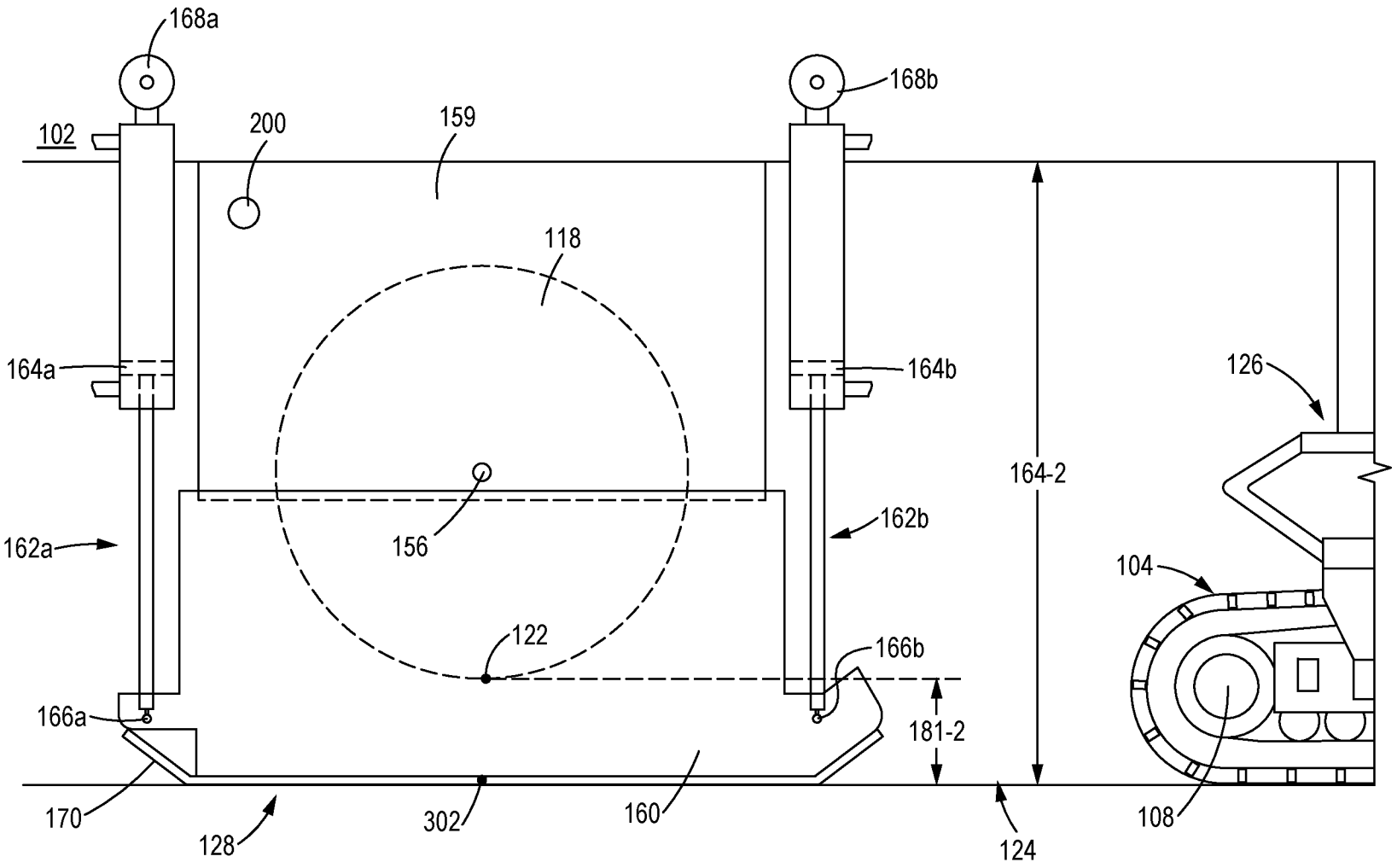
FIG. 9 is a side view of a machine in a second mode of operation, in accordance with an embodiment of the present disclosure.

FIG. 9 is a side view of a machine in a second mode of operation, in accordance with an embodiment of the present disclosure. In particular, FIG. 9 depicts the cold planer machine 100 operating with the position-sensing hydraulic cylinders 162*a*, 162*b* operating in a float mode. In some embodiments, the cold planer machine 100 depicted in FIG. 8 transitions to the cold planer machine 100 depicted in FIG. 9 by manually lowering the vertical wall 160. In such a transition, the rate of the relative vertical distance 164 may be decreasing at a rate greater than threshold rate to actuate fluid spray. However, because the vertical wall 160 is in manual operation, as opposed to a float operation, fluid spray is not actuated.

In a float mode of operation, the position-sensing hydraulic cylinders 162*a*, 162*b* are not positioned by hydraulic pressure via hydraulic connections 163*a*, 163*b*. Rather, the vertical wall 160 is allowed to move, or float, independent of the hydraulic pressure. Here, the vertical wall 160 abuts the road surface 124 and is lower than depicted in FIG. 8. The relative vertical distance 164-2 is larger than the relative vertical distance 164-1. The height 180-2 is not depicted, as the bottom edge 171 (e.g., the skid 170), and more specifically its position 302, abuts against the road surface 124. The bottom of the drum 122 is at a height of 181-2 and remains above the road surface 124.

Figure 10:
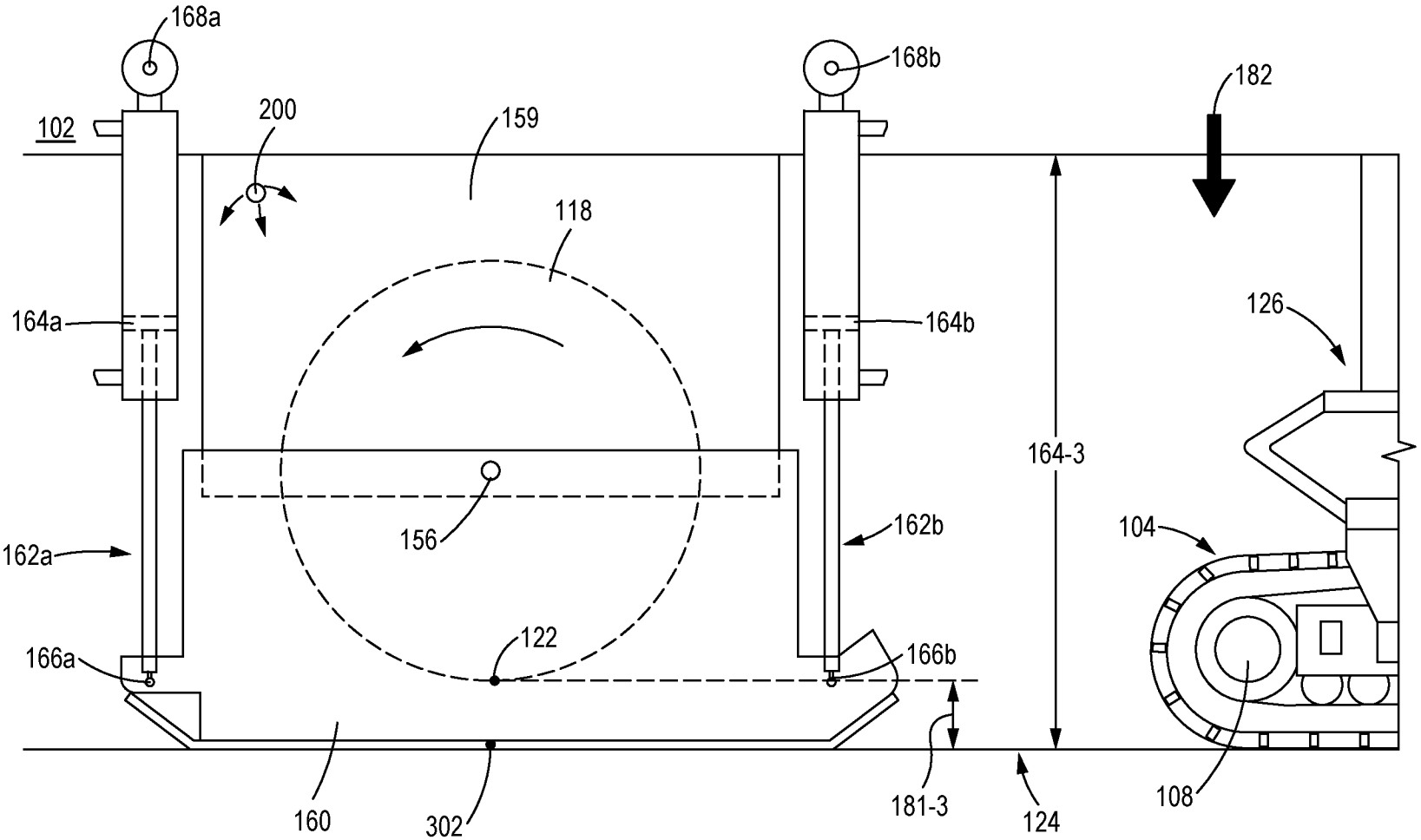
FIG. 10 is a side view of a machine in a third mode of operation, in accordance with an embodiment of the present disclosure.

FIG. 10 is a side view of a machine in a third mode of operation, in accordance with an embodiment of the present disclosure. In particular, FIG. 10 depicts the cold planer machine 100 performing a plunge cut operation. During a plunge cut operation, the retracting vertical actuator(s) 126 retracts to lower the height of the frame 102, as indicated by the arrow 182. As the frame 102 is lowered towards the road surface 124, the drum 118 is also lowered and is rotating. Thus, the relative vertical distance 164-3 and the height 181-3 are both decreasing at the same rate as both the frame 102 and the bottom of the drum 122 are lowered into the road surface 124. The skid 170 remains abutting against the road surface 124. Further, the drive motor 108 may also be secured or not engaged, meaning that the cold planer machine 100 is not moving either forwards (to the right in FIG. 10) or backwards (to the left in FIG. 10).

During a plunge cut operation, such as depicted in FIG. 10, fluid spray may be actuated via the spray bank 200. This may be performed in response to determining that a plunge cut operation is occurring based at least in part on the controller 210 determining that the position-sensing hydraulic cylinders 162*a*, 162*b* are operating in a float mode and the rate of height change of the vertical wall 160 (e.g., a side plate or rear mold board) is decreasing greater than a first threshold rate. An example first threshold rate may be set any value between 0.25 to five (5) mm per second, or the like. As the cold planer machine 100 starts to cut into the road surface 124 (e.g., as indicated at least in part by the relative vertical distance 164-3 decreasing greater than a threshold rate), the spray system 204 actuates fluid spray to lubricate and cool the drum 118.

Figure 11:
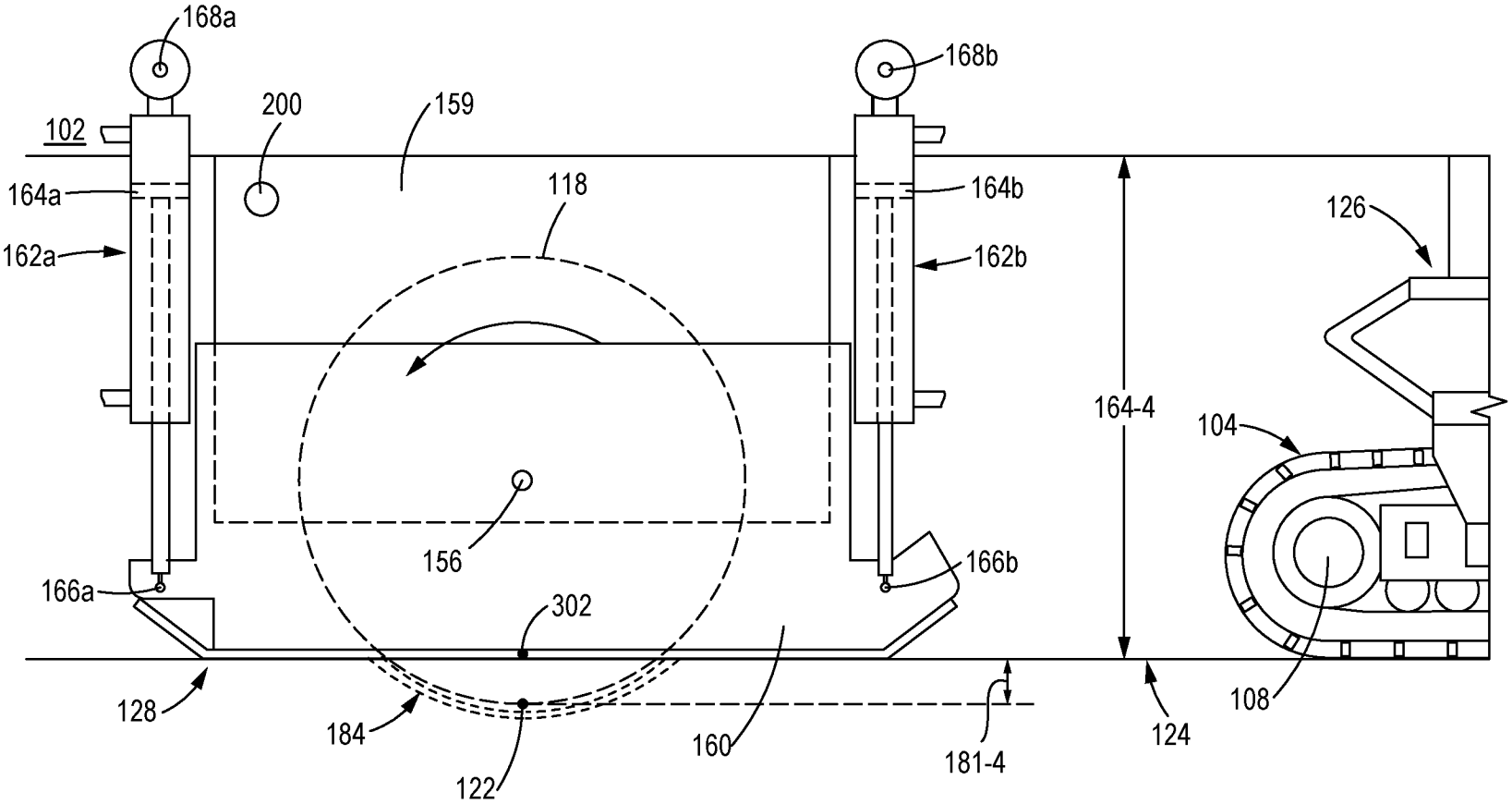
FIG. 11 is a side view of a machine in a fourth mode of operation, in accordance with an embodiment of the present disclosure.

FIG. 11 is a side view of a machine in a fourth mode of operation, in accordance with an embodiment of the present disclosure. In particular, FIG. 11 depicts the cold planer machine 100 after performing a plunge cut operation. The retracting vertical actuator 126 has stopped retracting and the frame 102 is at a constant height. The relative vertical distance 164-4 has become smaller than the relative vertical distance 164-3 of FIG. 10 because the drum 118 has cut into the road surface 124 at the recess 184. The skid 170 remains abutting the road surface 124, and the bottom of the drum 122 is below the road surface 124, as indicated by the height 181-4 extending below the road surface 124. Here, as the frame 102 and the drum 118 are no longer being lowered into the road surface 124 and the drum 118 is not interacting and cutting into any new road surface 124, the fluid flow from the spray bank 200 may be secured. In some embodiments, the fluid flow is secured immediately after the plunge cut operation is secured or flow may be secured after a time delay passes after the rate of height change (e.g., rate of change of the relative vertical distance 164-5) decreases below a threshold rate. An example time delay may be any time between two (2) seconds and fifteen (15) seconds, or any other suitable time delay.

Figure 12:
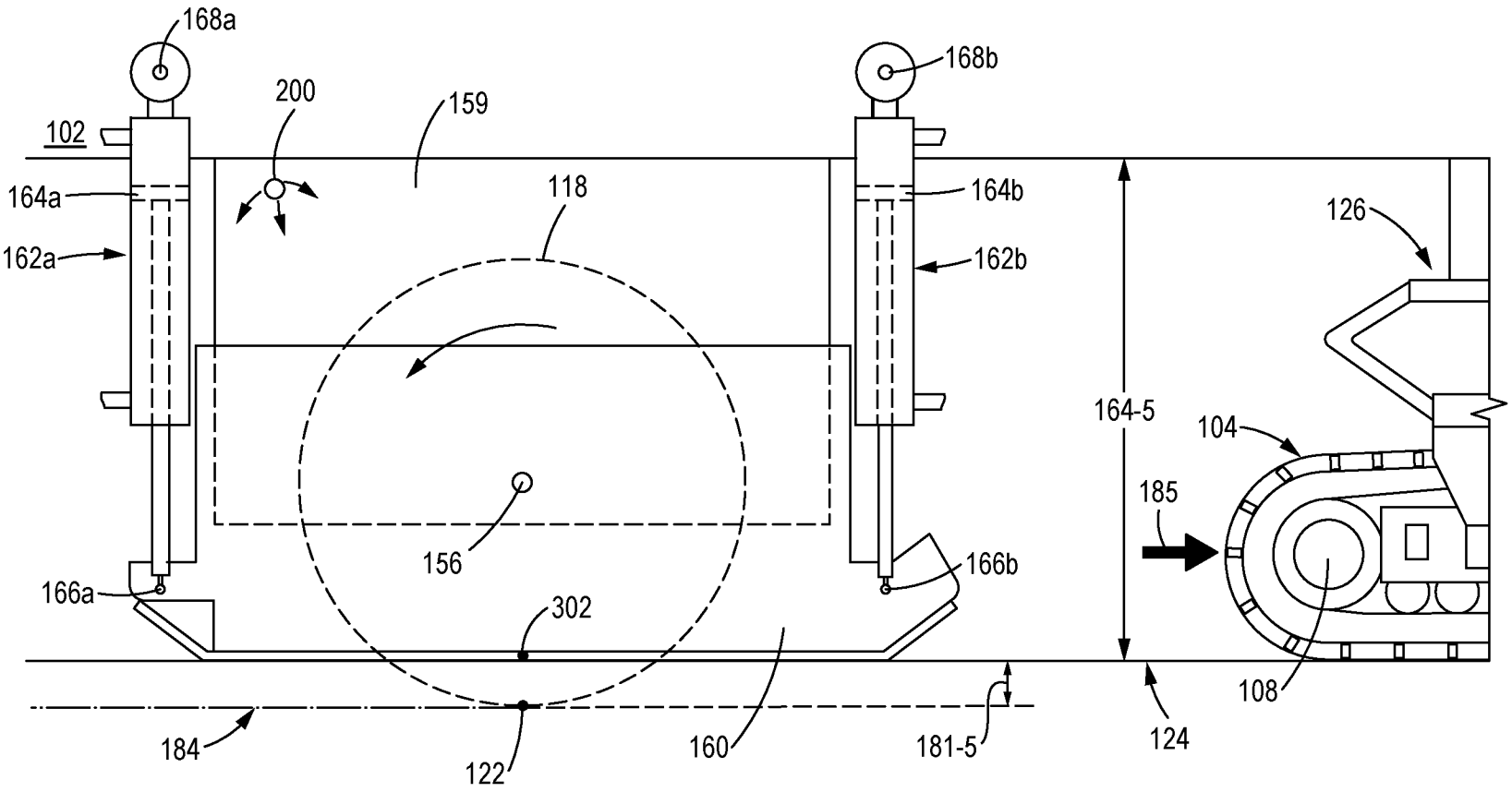
FIG. 12 is a side view of a machine in a fifth mode of operation, in accordance with an embodiment of the present disclosure.

FIG. 12 is a side view of a machine in a fifth mode of operation, in accordance with an embodiment of the present disclosure. In particular, FIG. 12 depicts the cold planer machine 100 performing a milling operation. Here, the frame 102 is maintained at a constant height above the road surface 124 (e.g., a relative vertical distance 164-5 that is constant). Further, the bottom edge 171 still abuts against the road surface 124 and the bottom of the drum 122 is at the height 181-5, which is below the road surface 124 and may be the same height as depicted by 181-4 of FIG. 11. However, the drive motor 108 is activated to advance the cold planer machine 100 to the right, as indicated by the arrow 185. Thus, the drum 118 that is rotating is cutting into new road surface 124 and the cold planer machine 100 advances to the right. The portion of the road surface 124 removed by the drum 118 as the cold planer machine 100 advances to the right is indicated by the recess 184. During the milling operation, the spray system 204 may actuate fluid spray via the spray bank 200.

Similar to the depiction of the cold planer machine 100 of FIG. 11, fluid spray may be secured after the cold planer machine is no longer performing the milling operation. For example, after the drive motor 108 secures, the cold planer machine 100 will stop advancing, and the drum 118 will not interact with (e.g., cut or plane) new road surface 124. After securing the milling operation, the spray system 204 may secure the fluid spray immediately or after a time delay.

In some embodiments, the controller 210 actuates and secures fluid spray from the spray bank 200 and the conveyer system spray banks 220 in a cascading method. For example, after detecting that either a milling operation or a plunge cut operation has commenced, the spray bank 200 in the housing 128 may actuate at a first time (e.g., as soon as the operation is detected by the controller 210) and the conveyer system spray bank 220 may be actuated at a second time that is after actuation of the spray bank 200. Thus, fluid spray is initially actuated within the housing 128 as soon as the road surface planing operation starts, but spray to the conveyer system 134 is delayed as it may not be needed until a short time later (e.g., 1-5 seconds after fluid spray in the housing is actuated) when the road debris is transported up via the conveyer system 134. Further, embodiments with the secondary conveyer system 144 may also be equipped with conveyer system spray banks that actuate at an even later time than the conveyer system spray banks 220. Finally, securing of spray flow through the various spray banks may likewise be staggered, with the spray bank 200 within the housing securing first, followed by fluid spray being secured to the conveyer system 134 and secondary conveyer system 144 at later times.

While the above different views of FIG. 8-11 depict the vertical wall 160 and its respective position detector(s) 162 providing inputs to the controller 210 to actuate and secure fluid spray, it is envisioned that the controller 210 may actuate fluid spray based on a relative height or relative vertical distance of any of a right-side plate, a left-side plate, both a left and right side-plate, a rear mold board, and the like. For example, in an embodiment that the controller 210 receives relative height measurements of both a left side plate and a right side plate, fluid spray may be actuated based on position measurements from either the left side plate or the right side plate providing indications that a planing operation is occurring.

In some embodiments, detecting that a milling operation is occurring includes the spray system 204 operating in an automatic mode, the drive motors 108 being on and operating in a forward mode. Further, any one of the left side plate, the right side plate or the mold board relative height positions may be greater than a first threshold value. In yet another embodiment, detecting that a milling operation may only be based on the positions of the left side plate and the right side plate without detecting the position of the mold board. In such embodiments, fluid spray may be actuated immediately after determining that the milling operation is occurring. In some such embodiments, the vertical wall 160 may be operating in either a manual mode or a float-mode.

After detecting that the conditions for a milling operation are no longer present, the controller 210 may secure spraying. For example, the controller 210 may secure spray flow after a time delay (e.g., a time delay between 0.5 to five seconds) after determining that a milling operation is no longer occurring.

In some embodiments, detecting that a plunge cut operation is occurring includes the spray system 204 operating in automatic mode and the drive motors 108 being on but in neutral (e.g., not advancing the machine). Further, any one of the left side plate, the right side plate or the mold board positions may be decreasing greater than a first threshold rate. Responsive to determining that the plunge cut operation is occurring, the spray system 204 may actuate spray flow immediately.

After detecting that the conditions for a plunge cut operation are no longer present, the controller 210 may secure spraying. In one embodiment, the controller 210 may secure spray flow after a time delay (e.g., a time delay greater than the time delay for securing spray flow after a milling operation) after determining that a plunge cut operation is no longer occurring.

INDUSTRIAL APPLICABILITY

In general, the present disclosure may find applicability with cold planer machines for any number of industrial settings. For example, the teachings of this disclosure may be employed in road and highway resurfacing applications, although other uses are certainly possible. By utilizing the systems and methods disclosed herein, the cold planer machine 100 may implement automatic fluid spray during planing operations.

Figure 13:
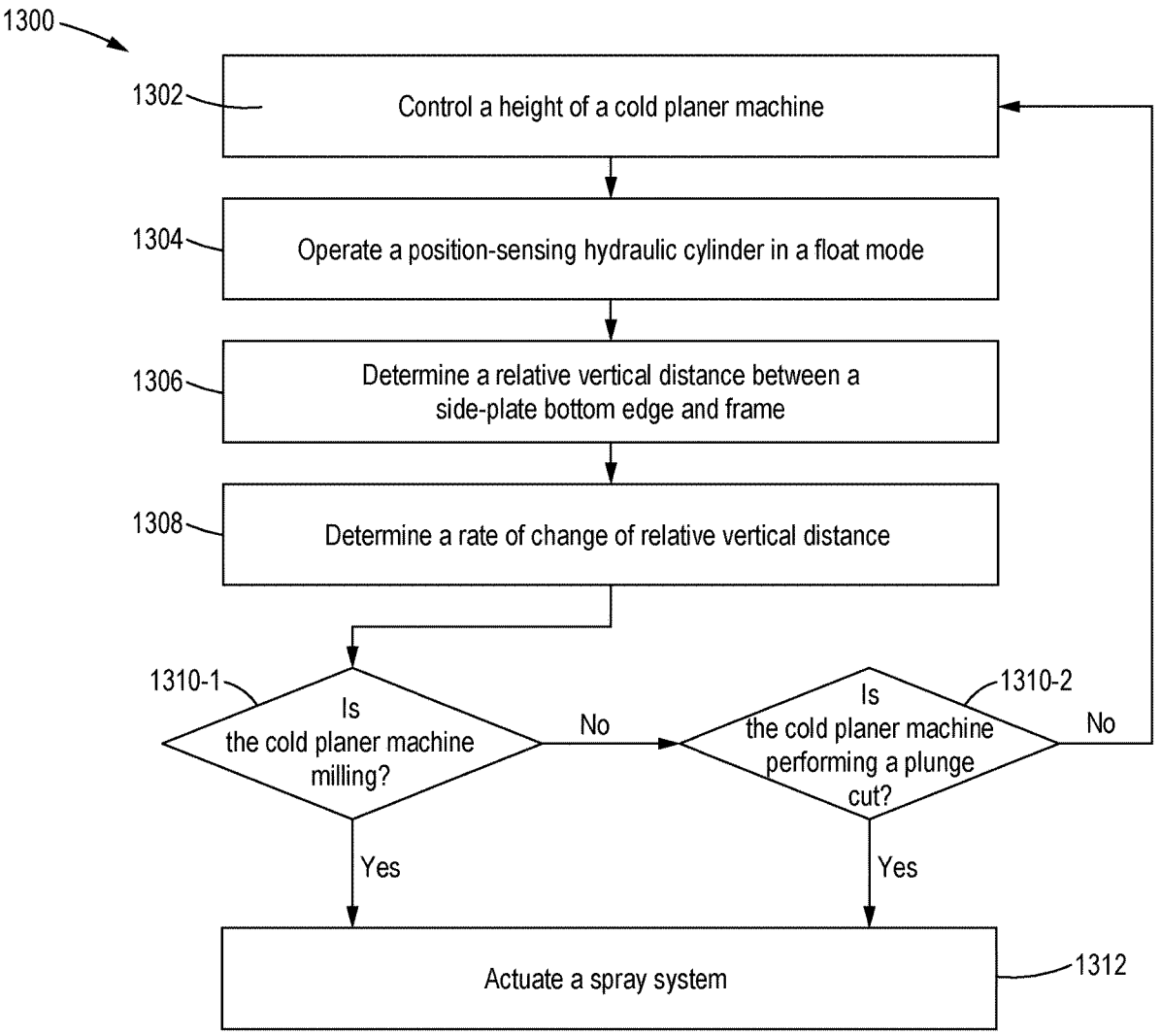
FIG. 13 depicts a method depicting a sample sequence which may be practiced, in accordance with an embodiment of the present disclosure.

FIG. 13 depicts a method depicting a sample sequence which may be practiced, in accordance with an embodiment of the present disclosure. In particular, FIG. 13 depicts the method 1300 that includes controlling a height of a cold planer machine at 1302, operating a position-sensing hydraulic cylinder in a float mode at 1304, determining a relative vertical distance between a side-plate bottom edge and a frame at 1306, determining a rate of change of relative vertical distance at 1308, determining if the cold planer machine is performing a milling (1310-1) or plunge cut (1310-2) operation, and actuating a spray system at 1312.

At 1302, the height of the cold planer machine is controlled above a road surface via a retracting vertical actuator system disposed between a ground engaging member and the frame. The ground engaging member is adapted to interact with the road surface and advance the cold planer machine in response to activation of a drive motor.

At 1304, a position-sensing hydraulic cylinder system on a side plate is operating in a float mode. The side plate is a vertical wall of a housing mounted to the frame, and includes a bottom edge that abuts with the road surface when the position-sensing hydraulic cylinder system is operating in the float mode. The housing includes a drum enclosed within the housing and attached to the frame. The drum is arranged to rotate about a drum axis to plane the road surface during operation.

At 1306, a relative vertical distance between the side-plate bottom edge and the frame is determined based at least in part on a position measurement from the position-sensing hydraulic cylinder system. At 1308, a rate of change of the relative vertical distance may be determined.

At 1310-1 and 1310-2, a determination that the cold planer machine is planing the road surface is based at least in part on the detecting that the cold planer machine is performing either one of a plunge cut operation or a milling operation.

At 1310-1, the determination that the cold planer machine is performing the milling operation is determined at least in part on the drive motor being activated (e.g., advancing the cold planer machine), the position-sensing hydraulic cylinder system operating in the float mode, and the determined relative vertical distance corresponds to a bottom of the drum being below the side-plate bottom edge (e.g., exceeding a threshold height). Responsive to determining that the cold planer machine is performing a milling operation, spray flow may be actuated at 1312.

At 1310-2, the determination that the cold planer machine is performing the plunge cut operation is based at least in part on the drive motor being secured (e.g., not advancing the cold planer machine), the position-sensing hydraulic cylinder system operating in a float mode, and the determined rate of change of the relative vertical distance being greater than a threshold rate. Responsive to determining that the cold planer machine is performing a plunge cut operation, spray flow may be actuated at 1312. Otherwise, the method 1300 may repeat.

At 1312, responsive to determining that the cold planer machine is planing the road surface, a spray system is actuated. The spray system is disposed at least in part in the housing and includes a nozzle arranged to spray a fluid directed at the drum. Further, the spray system may include additional spray bank within the housing and spray banks along a conveyer system of the cold planer machine.

After determining that the cold planer machine is no longer performing a planing operation, the fluid spray may be secured automatically. In some embodiments, the fluid spray is secured after a first time delay after detecting that a milling operation is secured and that a plunge cut operation has not commenced. Fluid spray is secured after a second time delay after detecting that a plunge cut operation has secured and that a milling operation has not commenced. The second time delay may be longer than the first time delay. In some embodiments, the first time delay is between 0.5 seconds and 4.5 seconds and the second time delay is between five (5) seconds and ten (10) seconds, thus permitting spray to be actuated for a longer period after a plunge cut than after a milling operation.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features but not to exclude such from the scope of the disclosure entirely unless otherwise indicated.

Recitation of ranges of values herein are merely intended to serve as a shorthand method of referring individually to each separate value falling within a range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A spray system for a cold planer machine, the spray system comprising:

a spray bank disposed inside a housing and arranged to spray fluid directed at a drum; and a spray controller, the spray controller being configured to:

receive an indication indicative of a plunge cut operation is occurring, wherein the indication indicative of the plunge cut operation comprises an indication that is based on a speed the drum is being inserted into a road surface; and actuate fluid spray via the spray bank based at least in part on the received indication.

2. The spray system of claim 1, wherein:

the indication indicative the plunge cut operation is a position measurement indicative of a relative vertical distance between a vertical wall on the housing and a frame of the cold planer machine; and fluid spray is actuated at least in part based on the spray controller determining that the relative vertical distance is above a first threshold height value.

3. The spray system of claim 1, further comprising a conveyer system spray bank to generate fluid spray towards material being transported from the housing, wherein the spray controller is further configured to actuate fluid spray from the spray bank at a first time and actuate fluid spray from the conveyer system spray bank at a second time after the first time.

4. The spray system of claim 1, wherein the spray controller is further configured to:

actuate fluid spray via the spray bank after determining that a milling operation is occurring; and secure fluid spray after a first time delay after detecting that the conditions for the milling operation is no longer occurring.

5. The spray system of claim 1, wherein the indication indicative of the plunge cut operation is a position measurement received from a LIDAR sensor configured to output a position measurement indicative of a height of the vertical wall as related to the frame.

6. The spray system of claim 1, wherein the spray bank comprises a first spray bank and a second spray bank and the spray controller separately actuates fluid spray via the first spray bank and the second spray bank.

7. The spray system of claim 6, wherein the spray controller actuates fluid spray from the first spray bank and the second spray bank based at least in part on a type of a road surface.

8. The spray system of claim 6, wherein the spray controller actuates fluid spray from both the first and the second spray bank based on at least one of an operating speed of a drive motor and a speed that the drum is being inserted into a road surface.

9. The spray system of claim 1, wherein the indication of the plunge cut operation is based in part on a position measurement from a position sensing hydraulic cylinder that is operably connected to a vertical wall of the housing.

10. The spray system of claim 1, the spray system further comprises a first position-sensing hydraulic cylinder disposed at a front end of the vertical wall and a second position sensing hydraulic cylinder disposed at a back end of the vertical wall, wherein the indication of the plunge cut operation is based in part on position measurements from both the first and the second position sensing hydraulic cylinders.

11. The spray system of claim 10, wherein the position measurements from both the first and second position sensing hydraulic cylinders correspond to a height of a position of a bottom edge of the vertical wall in proximity to a bottom of the drum.

12. A spray system for a cold planer machine, the spray system comprising:

a spray bank disposed inside a housing and arranged to spray fluid directed at a drum; and a spray controller, the spray controller being configured to:

receive an indication indicative of a milling operation, wherein the indication of the milling operation comprises a spray system operating in an automatic mode; and actuate fluid spray via the spray bank based at least in part on received indication.

13. The spray system of claim 12, further comprising a position sensing hydraulic cylinder system operably connected to a vertical wall of the housing and a frame of the cold planer machine and configured to generate a position measurement indicative of a relative height of a vertical distance between the vertical wall and the frame, wherein the indication indicative of the milling operation further comprises a position measurement from the position sensing hydraulic system.

14. The spray system of claim 13, wherein:

the position-sensing hydraulic cylinder system comprises a first position-sensing hydraulic cylinder disposed at a front end of the vertical wall and a second position-sensing hydraulic cylinder disposed at a back end of the vertical wall;

the position measurement is based at least in part on position measurements from both the first and second position-sensing hydraulic cylinders and corresponds to a height of a position of a bottom edge in proximity to a bottom of the drum; and the spray controller actuates fluid spray responsive to determining the position measurement is less than a first threshold height value corresponding to a frame height at which the bottom of the drum interacts with a road surface.

15. The spray system of claim 12, wherein the indication indicative of a milling operation is a drive-motor status signal from a drive motor that is configured to drive a ground engaging member of the cold planer machine, and actuation of fluid flow via the spray bank is based at least in part on receiving a drive-motor status signal indicative of activation of the drive motor.

16. The spray system of claim 12, wherein the indication indicative of the milling operation includes at least one of a drive motor operating in a forward mode, and a relative height of the vertical wall being greater than a threshold height.

17. A cold planer machine, comprising:

a frame;

a ground engaging member adapted to interact with a road surface;

a retracting vertical actuator system disposed between the frame and the ground engaging member to raise and lower the frame;

a housing including a vertical wall movable relative to the frame;

a drum enclosed within the housing and arranged to rotate about a drum axis, the drum is connected to the frame and configured to plane the road surface during operation; and a spray system, the spray system comprising:

a spray bank comprising a first spray bank and a second spray bank, the spray bank disposed inside the housing and arranged to spray fluid directed at the drum; and a spray controller configured to:

receive an indication indicative of a road surface planing operation;

actuate fluid spray via the first spray bank based at least in part on receiving the indication indicative of the road surface planing operation; and actuate fluid spray via the second spray bank based on determining either one of the cold planer machine is advancing at a speed greater than a threshold speed and the drum being inserted into the road surface at a speed greater than a threshold rate.

18. The cold planer machine of claim 17, the spray controller being further configured to receive a drive-motor status signal from a drive motor that is configured to drive a ground engaging member of the cold planer machine, and the indication indicative of the road surface planing operation is a drive-motor status signal indicative of the drive motor not being activated.

19. The cold planer machine of claim 17, the spray controller being further configured to secure fluid spray after a first time delay after a determination that road surface planing operation is no longer occurring.

20. The cold planer machine of claim 17, wherein the indication of a road surface planing operation comprises a position measurement received from a LIDAR sensor configured to output a position measurement indicative of a height of the vertical wall.

* * * * *